US012669025B2

(12) United States Patent
Stevenson et al.

(10) Patent No.: US 12,669,025 B2
(45) Date of Patent: Jun. 30, 2026

(54) DUAL FLEXIBLE SHAFT APPARATUS FOR IMPROVED DOWNHOLE OPERATIONS

(71) Applicant: Schlumberger Technology Corporation, Sugar Land, TX (US)

(72) Inventors: Idalia Ovalle Stevenson, Sugar Land, TX (US); Rishi Mishra, Rosenberg, TX (US); Dan Tabalan, Sugar Land, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 19/205,276

(22) Filed: May 12, 2025

(65) Prior Publication Data

US 2025/0347184 A1 Nov. 13, 2025

Related U.S. Application Data

(60) Provisional application No. 63/644,569, filed on May 9, 2024.

(51) Int. Cl.
*E21B 27/00* (2006.01)
*E21B 37/00* (2006.01)

(52) U.S. Cl.
CPC ..... *E21B 27/00* (2013.01); *E21B 37/00* (2013.01)

(58) Field of Classification Search
CPC ..... E21B 4/006; E21B 27/00; E21B 27/005; E21B 27/02; E21B 27/04; E21B 37/00
See application file for complete search history.

(56) References Cited

U.S. PATENT DOCUMENTS

| | | | | |
|---|---|---|---|---|
| 7,096,975 | B2 * | 8/2006 | Aronstam | E21B 19/09 175/48 |
| 7,478,687 | B2 | 1/2009 | Lynde | |
| 7,575,056 | B2 | 8/2009 | Fuhst | |
| 7,946,360 | B2 * | 5/2011 | Orban | E21B 27/04 175/321 |
| 8,316,965 | B2 * | 11/2012 | Hallundbaek | E21B 27/005 175/102 |
| 8,453,724 | B2 | 6/2013 | Zhou | |
| 10,526,845 | B2 * | 1/2020 | Gråbæk | E21B 23/00 |
| 10,704,351 | B2 | 7/2020 | Haugland | |
| 10,767,447 | B2 | 9/2020 | Kartha | |

(Continued)

FOREIGN PATENT DOCUMENTS

| | | | | |
|---|---|---|---|---|
| CA | 2560461 C | * | 6/2010 | E21B 33/076 |
| CN | 114635655 A | * | 6/2022 | E21B 21/00 |

(Continued)

*Primary Examiner* — Jennifer H Gay
(74) *Attorney, Agent, or Firm* — Jeffrey D. Frantz

(57) ABSTRACT

Systems and a tool are disclosed herein for improved debris collection within a wellbore. An example debris collection tool can include a motor rotationally coupled to a pump by a first flexible shaft, the pump rotationally coupled to a gearbox by a second flexible shaft, and the gear box rotationally coupled to a milling bit by an additional shaft. The flexible shafts can be made of a flexible, but durable material that can absorb strain created by a pump whose rotor rotates eccentrically with the axis of rotation offset from the axis of symmetry. The flexible shafts can be made of a durable and flexible material that can withstand the strain created by the eccentric rotation.

20 Claims, 3 Drawing Sheets

(56) References Cited

U.S. PATENT DOCUMENTS

| | | | | |
|---|---|---|---|---|
| 10,858,900 | B2 | 12/2020 | Haugland | |
| 11,111,748 | B2 | 9/2021 | Mahajan | |
| 11,125,033 | B2 * | 9/2021 | Edvardsen | E21B 27/00 |
| 11,319,763 | B2 | 5/2022 | Haugland | |
| 11,560,756 | B2 * | 1/2023 | Schultz | F16H 1/32 |
| 11,708,746 | B1 | 7/2023 | Xiao | |
| 11,788,383 | B2 * | 10/2023 | Schindler | E21B 10/00 166/311 |
| 11,795,773 | B2 | 10/2023 | Garcia | |
| 11,802,463 | B2 | 10/2023 | Haugland | |
| 12,234,700 | B2 * | 2/2025 | Sheiretov | F16H 1/46 |
| 12,338,699 | B1 * | 6/2025 | Yang | E21B 29/002 |
| 12,345,111 | B1 * | 7/2025 | Mishra | E21B 7/006 |
| 12,428,910 | B1 * | 9/2025 | Feddema | F16H 57/082 |
| 12,486,720 | B1 * | 12/2025 | Chamarthy | E21B 4/006 |
| 2004/0256161 | A1 * | 12/2004 | Aronstam | E21B 21/00 175/232 |
| 2006/0213667 | A1 * | 9/2006 | Mashburn | E21B 21/002 166/227 |
| 2008/0277166 | A1 * | 11/2008 | Orban | E21B 41/0035 175/76 |
| 2009/0279966 | A1 | 11/2009 | Blair | |
| 2010/0018775 | A1 * | 1/2010 | Hallundbaek | E21B 27/005 175/94 |
| 2016/0040486 | A1 * | 2/2016 | Eppink | E21B 4/02 175/74 |
| 2018/0029869 | A1 | 2/2018 | Carapelli | |
| 2018/0058146 | A1 * | 3/2018 | Gråbæk | E21B 4/04 |
| 2019/0345769 | A1 * | 11/2019 | Schultz | E21B 4/006 |
| 2020/0102809 | A1 * | 4/2020 | Schindler | E21B 21/002 |
| 2020/0300049 | A1 * | 9/2020 | Edvardsen | E21B 27/04 |
| 2024/0141750 | A1 * | 5/2024 | Randle | E21B 34/066 |
| 2024/0301770 | A1 * | 9/2024 | Kibbe | E21B 43/128 |
| 2024/0418050 | A1 * | 12/2024 | Sheiretov | E21B 29/00 |
| 2025/0250867 | A1 * | 8/2025 | Funderud | E21B 21/10 |
| 2025/0270889 | A1 * | 8/2025 | Purusharthy | E21B 27/005 |
| 2025/0347184 | A1 * | 11/2025 | Stevenson | E21B 37/00 |
| 2025/0361794 | A1 * | 11/2025 | Wiesenborn | F04D 25/0686 |

FOREIGN PATENT DOCUMENTS

| | | | | |
|---|---|---|---|---|
| DK | 180023 | B1 | 1/2020 | |
| EP | 2458134 | A2 | 5/2012 | |
| EP | 2516793 | B1 | 4/2017 | |
| EP | 4647577 | A1 * | 11/2025 | E21B 37/00 |
| NO | 342058 | B1 | 3/2018 | |
| WO | WO-2005095751 | A1 * | 10/2005 | E21B 17/206 |
| WO | 2020122732 | A1 | 6/2020 | |
| WO | 2021226214 | A1 | 11/2021 | |
| WO | 2022069480 | A1 | 4/2022 | |
| WO | WO-2023183577 | A1 * | 9/2023 | F16H 1/46 |

* cited by examiner

DUAL FLEXIBLE SHAFT APPARATUS FOR IMPROVED DOWNHOLE OPERATIONS

CROSS-REFERENCE TO RELATED APPLICATION

The present disclosure claims priority from U.S. Provisional Patent Application No. 63/644,569, filed on May 9, 2024, and herein incorporated by reference in their entireties.

BACKGROUND

Field

The present disclosure generally relates to a downhole tool, and more particularly to methods and apparatus for loosening and collecting wellbore debris.

Description of the Related Art

Hydrocarbons may be produced from wellbores drilled from the surface through a variety of producing and non-producing formations. The wellbore may be drilled substantially vertically or may be an offset well that is not vertical and has some amount of horizontal displacement from the surface entry point. Often debris needs to be removed from the wellbore after it is drilled. Wellbore debris can include sand, scale, metallic junk, proppant, and other solids that may be mixed with pipe dope or asphaltenes. One of the challenges in designing a tool for removing debris is to provide a means to retain collected debris inside the collection chambers while the tool is being retrieved from the well.

SUMMARY

Systems, methods, and an apparatus are disclosed herein for improved downhole operations within a wellbore. An embodiment of the apparatus can have two flexible shafts, one coupled to each end of a pump. For example, downhole assembly can include an active debris removal machine or tool ("ADRM") coupled directly to one end of a pump using a first flexible shaft. The first flexible shaft can couple to a gearbox in the ADRM that is driven by a motor. The gearbox can control the speed and torque at which the motor drives the first flexible shaft. The other end of the pump can couple directly to another gear box using the second flexible shaft. The second gearbox allows the motor to drive components downhole of the pump at a different speed and torque. For example, additional shafts can pass through a bailer and check valve to a milling bit at the downhole end of the downhole assembly. The motor can simultaneously drive the pump and milling bit at different speeds and torques while performing debris removal operations in a wellbore.

The dual flexible shafts on either end of the pump allow a motor to drive components downhole of the pump in instances where the pump rotor deviates from its central axis while it spins (i.e., experiences "wobbling"). For example, the rotor of a progressive cavity pumps ("PCPs") typically has a helical shape with protruding sections that engage with the stator. These elevated portions, or peaks, create chambers of varying volume as the rotor rotates within the stator. Valleys form the lower sections between the peaks and contribute to the changing chamber volumes within the pump. As the rotor turns, the peaks move through the stator cavities, creating a progressive cavity effect that propels fluid through the pump. At the same time, fluid is drawn into the expanding valleys and then displaced as the rotor progresses, creating a continuous flow. The rotor is intentionally offset or misaligned from the center of the stator, creating eccentricity to generate the progressive cavity effect. In other words, when the rotor rotates, its axis of rotation is offset from its axis of symmetry.

This eccentric movement in a PCP, however, causes the rotor to wobble slightly within the stator. The wobble would create a considerable amount of stress on any rigid shaft coupled to the PCP. The dual flexible shafts in the apparatus described herein allow for a motor to drive additional components downhole of a pump with eccentric movements like a PCP pump.

A debris collection tool is also disclosed for use with the methods described herein.

BRIEF DESCRIPTION OF THE FIGURES

Certain embodiments, features, aspects, and advantages of the disclosure will hereafter be described with reference to the accompanying drawings, wherein like reference numerals denote like elements. It should be understood that the accompanying figures illustrate the various implementations described herein and are not meant to limit the scope of various technologies described herein.

DETAILED DESCRIPTION

In the following description, numerous details are set forth to provide an understanding of some embodiments of the present disclosure. It is to be understood that the following disclosure provides many different embodiments, or examples, for implementing different features of various embodiments. Specific examples of components and arrangements are described below to simplify the disclosure. These are, of course, merely examples and are not intended to be limiting. However, it will be understood by those of ordinary skill in the art that the system and/or methodology may be practiced without these details and that numerous variations or modifications from the described embodiments are possible. This description is not to be taken in a limiting sense, but rather made merely for the purpose of describing general principles of the implementations. The scope of the described implementations should be ascertained with reference to the issued claims.

As used herein, the terms "connect", "connection", "connected", "in connection with", and "connecting" are used to mean "in direct connection with" or "in connection with via one or more elements"; and the term "set" is used to mean "one element" or "more than one element". Further, the terms "couple", "coupling", "coupled", "coupled together", and "coupled with" are used to mean "directly coupled together" or "coupled together via one or more elements". As used herein, the terms "up" and "down"; "upper" and "lower"; "top" and "bottom"; and other like terms indicating relative positions to a given point or element are utilized to more clearly describe some elements. Commonly, these terms relate to a reference point at the surface from which drilling operations are initiated as being the top point and the total depth being the lowest point, wherein the well (e.g., wellbore, borehole) is vertical, horizontal or slanted relative to the surface.

Figure 1:
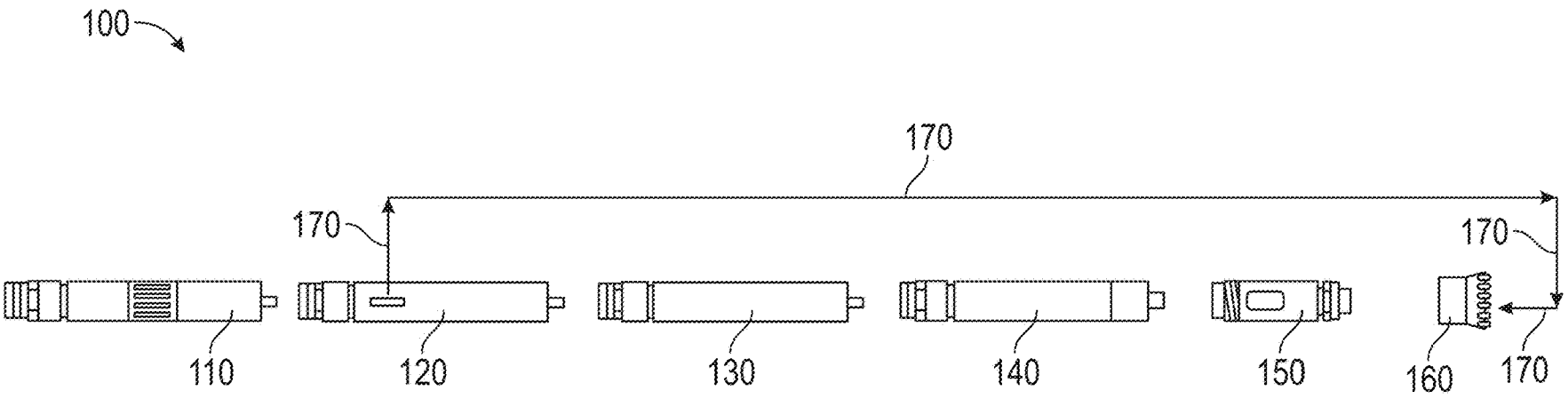
FIG. 1 depicts an embodiment of a downhole assembly for debris removal.

FIG. 1 shows a schematic of an example debris removal tool 100, according to an embodiment of the disclosure. The debris removal tool 100 includes an ADRM 110, a pump 120, and gearbox 130, a bailer 140, a check valve 150, and a milling bit 160. When positioned inside a wellbore, the ADRM 110 is at the uphole end and the milling bit 160 is at the downhole end. The ADRM 110 includes subcomponents that drive the various components of the downhole assembly. These subcomponents are described in more detail later herein. The ADRM 110 can drive the pump 120, which forces drilling fluid out of the debris removal tool 100 and into cavity of the wellbore. The drilling fluid can be any fluid used in drilling operations, such as a water-based mud that includes water, clays, polymers, and additives; an oil-based mud that includes mineral oil or synthetic oil, clays, and various additives; a synthetic-based mud that includes synthetic oils and additives; a brine-based mud that includes water with high salt content (brine) and additives; or a polymer drilling fluid that includes water with added polymers.

The drilling fluid can be pulled back into the downhole assembly through the milling bit 160, as indicated by the arrows 170. The milling bit 160 can be any kind of flow-through bit that allows fluids and debris to pass through it into the debris removal tool 100. The milling bit can break up rock formations, which results in debris. The pump 120 can create a suction force that pulls the drilling fluid and debris into the debris removal tool 100 through the milling bit 160 and the check valve 150, and into the bailer 140. The check valve 150 can be a valve that allows one-directional flow of fluid into the debris removal tool 100. This prevents any fluid and debris from returning into the wellbore after it has entered the bailer 140.

The bailer 140 can include filters (not shown), that catch debris pulled into the debris removal tool 100. Clean fluid then continues through the gearbox 130 and back into the pump 120 where it is then pumped back into the wellbore area.

Figure 2:
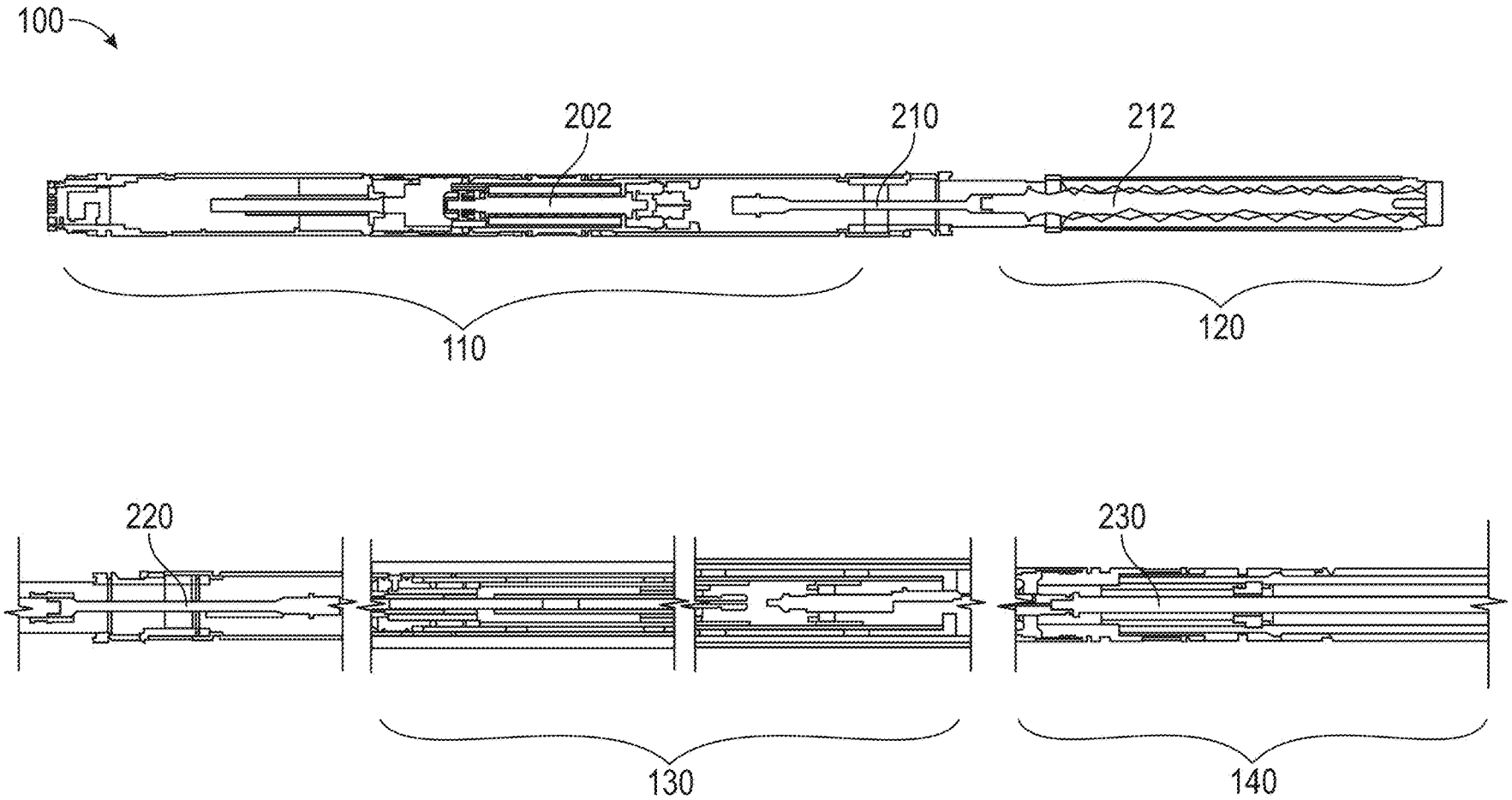
FIG. 2 depicts a schematic of downhole assembly for debris removal.

FIG. 2 depicts a detailed schematic of the debris removal tool 100. The ADRM 110 includes a motor 202 that is rotationally coupled to an uphole end of an upper flexible shaft 210. The upper flexible shaft 210 is rotationally coupled to the pump 120 at its other end. When activated, the motor 202 rotationally drives the upper flexible shaft 210, which in turn drives the pump 120. The upper flexible shaft 210 being flexible allows the motor 202 to drive any type of pump that exhibits eccentric movement. For example, eccentric movement in a PCP causes the rotor 212 to wobble slightly within the stator, resulting in a varying chamber volume. The type of pump movement creates significant strain on a rigid shaft, but the upper flexible shaft 210 can be made of a material that can handle such movement. For example, the upper flexible shaft can be made of titanium, a nickel-titanium alloy, an aluminum alloy, a beryllium-copper alloy, or a cobalt-chromium alloy.

The debris removal tool 100 can also include a lower flexible shaft 220 rotationally coupled to the downhole end of the pump 120. The lower flexible shaft 220 allows the components downhole of the pump 120 to be driven by the motor 202 despite the eccentric motion of the pump 120. For example, the lower flexible shaft 220 can be made of a flexible metal like the upper flexible shaft 210, which allows the lower flexible shaft 220 to absorb strain created by the pump's eccentric motion.

The downhole end of the lower flexible shaft 220 can be rotationally coupled to the gearbox 130. The gearbox 130 can include gears, bearings, and other subcomponents that modify the speed and torque generated by the motor 202. The downhole end of the gearbox 130 can be rotationally coupled to a third shaft 230 that passes through the bailer 140 and check valve 150 and is rotationally coupled to the milling bit 160. This allows the motor 202 to simultaneously drive the pump 120 and milling bit 160 and different speeds and torques. This in turn allows the downhole assembly to drill obstructions in the wellbore while simultaneously pulling in and filtering debris created by the drilling. The flexible shafts 210, 220 located uphole and downhole of the pump 120 allow for these simultaneous operations using a pump with eccentric motion, such as a PCP.

In one embodiment of the invention, the pump 120 can be rotationally coupled directly to the milling bit 160 by the lower flexible shaft 220. For example, the pump 120 can be configured without the gearbox 130. The lower flexible shaft 220 can pass through the bailer 140 and check valve 150 and couple directly to the milling bit 160. In such an embodiment, the motor 120 can be driven at two different speeds, depending on whether the milling bit 160 is being used to break apart obstructions. For example, the motor 202 can run at a slower speed during milling and then sped up to pull in debris resulting from the milling.

In another embodiment, the lower flexible shaft 220 can be coupled to an adapter on the uphole end of the bailer 140 that causes the bailer 140 and check valve 150 to rotate with the lower flexible shaft 220.

Figure 3:
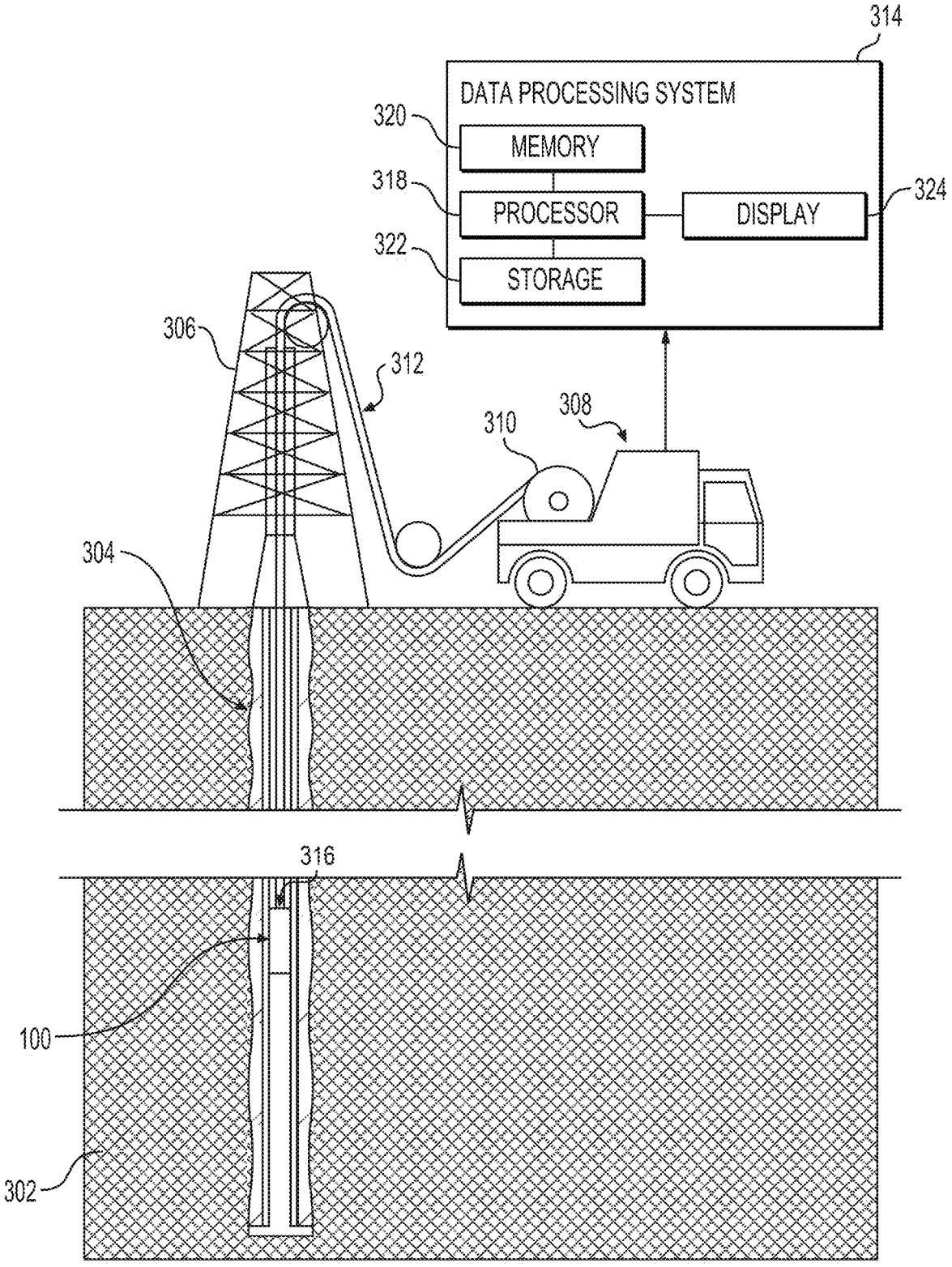
FIG. 3 depicts an exemplary well site where the present invention can be utilized.

FIG. 3 shows an exemplary well site where the debris removal tool 100 of the present invention can be utilized. A formation 302 has a drilled and completed wellbore 304. A derrick 306 above ground may be used to raise and lower components into the wellbore 304 and otherwise assist with well operations.

A wireline surface system 308 at the ground level includes a wireline logging unit, a wireline depth control system 310 having a cable 312, and a control unit 314. The cable is connected to a connection assembly 316 that may be lowered downhole. The control unit 314 includes a processor 318, memory 320, storage 322, and display 324 that may be used to display and control various operations of the wireline surface system 308, send and receive data, and store data.

The connection assembly 316 includes equipment for mechanically and electronically connecting the debris removal tool with the cable 312. The cable 312 includes a support wire, such as steel, to mechanically support the weight of the debris removal tool and communication wire to pass communications between the debris removal tool and the wireline surface system 308. The debris removal tool, as described in more detail below, is installed below the connection assembly.

The wireline surface system 308 can deploy the cable 312, which in turn lowers the connection assembly 316 and debris removal tool deeper downhole. Conversely, the wireline surface system 308 can retract the cable 312 and raise the debris removal tool and assembly, including to the surface. The cable 312 is deployed or retracted by the wireline depth control system 310, such as by unwinding or winding the cable 312 around a spool that is driven by a motor.

The wireline logging unit communicates with the control unit 314 to send and receive data and control signals. For example, the wireline logging unit can communicate data received from the debris removal tool to the control unit 314.

The wireline logging unit likewise can communicate data and control signals received from the electronic control system 314 to the debris removal tool. In some examples, the wireline logging unit is part of the control unit 314. In other examples, the control unit 314 sends and receives data to and from the debris removal tool directly.

Although FIG. 1 shows the debris removal tool being operated on a cable 312, the debris removal tool can be attached to other types of conveyance systems, such as coil tubing. Any conveyance system can be used to mechanically support the debris removal tool and mechanically raise or lower it within the wellbore 304. References to a "cable" are intended to be non-limiting, instead encompassing any known conveyance system.

In some embodiments, the shaft is fixed in the axial direction and results in axial motion of the housing. These embodiments may include ones where there is a separate concentric housing around the main housing which extends relative to the end of the main housing to accomplish a similar radial, axial, or helical debris stop.

Language of degree used herein, such as the terms "approximately," "about," "generally," and "substantially" as used herein represent a value, amount, or characteristic close to the stated value, amount, or characteristic that still performs a desired function or achieves a desired result. For example, the terms "approximately," "about," "generally," and "substantially" may refer to an amount that is within less than 10% of, within less than 5% of, within less than 1% of, within less than 0.1% of, and/or within less than 0.01% of the stated amount. As another example, in certain embodiments, the terms "generally parallel" and "substantially parallel" or "generally perpendicular" and "substantially perpendicular" refer to a value, amount, or characteristic that departs from exactly parallel or perpendicular, respectively, by less than or equal to 15 degrees, 10 degrees, 5 degrees, 3 degrees, 1 degree, or 0.1 degree.

Although a few embodiments of the disclosure have been described in detail above, those of ordinary skill in the art will readily appreciate that many modifications are possible without materially departing from the teachings of this disclosure. Accordingly, such modifications are intended to be included within the scope of this disclosure as defined in the claims. It is also contemplated that various combinations or sub-combinations of the specific features and aspects of the embodiments described may be made and still fall within the scope of the disclosure. It should be understood that various features and aspects of the disclosed embodiments can be combined with, or substituted for, one another in order to form varying modes of the embodiments of the disclosure. Thus, it is intended that the scope of the disclosure herein should not be limited by the particular embodiments described above.

What is claimed is:

1. A debris collection tool for debris collection within a wellbore, comprising:

a motor rotationally coupled to a first end of a pump by a first flexible shaft;

a gearbox rotationally coupled to a second end of the pump by a second flexible shaft, wherein the gearbox is configured to modify rotational speed and torque generated by the motor; and a milling bit rotationally coupled to the gearbox by an additional shaft, wherein the first and second flexible shafts are separate from the motor, the pump, and the gearbox, wherein the first and second flexible shafts each comprise a first end portion, a second end portion, and a shaft portion extending between the first and second end portions, and wherein the first and second end portions of the first and second flexible shafts each comprise a diameter greater than a shaft diameter of the shaft portion.

2. The debris collection tool of claim 1, further comprising a bailer positioned between the gearbox and the milling bit, the bailer comprising filters configured to trap debris pulled into the debris collection tool by the pump.

3. The debris collection tool of claim 2, further comprising a check valve positioned between the bailer and the milling bit.

4. The debris collection tool of claim 2, wherein the pump is configured to receive filtered drilling fluid from the bailer and direct the filtered drilling fluid to exit the debris collection tool and into the wellbore without flowing the drilling fluid through an interior of the debris collection tool.

5. The debris collection tool of claim 3, wherein the additional shaft passes through the bailer and the check valve.

6. The debris collection tool of claim 1, wherein the motor, when running, simultaneously drives the first flexible shaft at a first speed and a first torque and drives the second flexible shaft at a second speed and a second torque.

7. The tool of claim 6, wherein the first speed is faster than the second speed and the first torque is lower than the second torque.

8. The tool of claim 1, wherein the second flexible shaft is coupled to a bailer by an adapter that causes the bailer to rotate with the second flexible shaft.

9. The debris collection tool of claim 1, wherein a first length of the first flexible shaft and a second length of the second flexible shaft are at least 10 times greater than the shaft diameter of the shaft portion of each of the first flexible shaft and the second flexible shaft.

10. The debris collection tool of claim 9, wherein the first length and the second length are at least greater than a length of the gearbox.

11. The debris collection tool of claim 1, wherein the second end portion of the first flexible shaft and the first end portion of the second flexible shaft couples to the pump, and the second end portion of the second flexible shaft couples to the gearbox.

12. A debris collection tool for debris collection within a wellbore, comprising:

a motor rotationally coupled to a first end of a pump by a first flexible shaft; and a milling bit rotationally coupled to the pump by a second flexible shaft, wherein the second flexible shaft passes through a bailer positioned between the pump and the milling bit without a gearbox positioned between the pump and the milling bit.

13. The debris collection tool of claim 12, wherein a rotor of the pump, when the pump is activated, rotates eccentrically with respect to an axis of rotation of the pump being offset from an axis of symmetry of the pump.

14. The debris collection tool of claim 12, wherein the pump is a progressive cavity pump.

15. The debris collection tool of claim 12, wherein the first flexible shaft and the second flexible shaft comprise titanium, a nickel-titanium alloy, an aluminum alloy, a beryllium-copper alloy, or a cobalt-chromium alloy.

16. The debris collection tool of claim 12, wherein the bailer includes filters configured to trap debris pulled into the debris collection tool by the pump.

17. The debris collection tool of claim 16, further comprising a check valve positioned between the bailer and the milling bit.

18. The debris collection tool of claim 12, wherein the motor is configured to rotationally drive the first flexible shaft at a first speed during milling operations and a second speed during filtering operations.

19. The debris collection tool of claim 18, wherein the first speed is slower than the second speed.

20. The debris collection tool of claim 12, wherein the second flexible shaft is coupled to the bailer by an adapter that causes the bailer to rotate with the second flexible shaft.

* * * * *